United States Patent [19]

Robson

[11] Patent Number: 4,643,313

[45] Date of Patent: Feb. 17, 1987

[54] APPARATUS FOR THE CONTROLLED DISPENSING OF TABLETS FROM MULTIPLE CONTAINERS

[76] Inventor: Charles H. Robson, 6241 S. 30th St., Phoenix, Ariz. 85040

[21] Appl. No.: 801,850

[22] Filed: Nov. 26, 1985

[51] Int. Cl.[4] ..... B65D 83/04; B65D 85/56

[52] U.S. Cl. ..... 206/533; 206/536; 206/540; 221/119

[58] Field of Search ..... 206/533, 536, 540; 221/119; 222/144

[56] References Cited

U.S. PATENT DOCUMENTS

| | | | |
|---|---|---|---|
| 172,314 | 1/1876 | Hill et al. | 222/144 |
| 1,879,731 | 9/1932 | Buckley | 366/247 |
| 2,673,663 | 3/1954 | Calabro | 222/320 |
| 3,091,402 | 5/1963 | Palmer | 222/144 |
| 3,313,441 | 4/1967 | Fadden | 206/534 |
| 3,394,846 | 7/1968 | Carski et al. | 221/93 |
| 3,675,620 | 7/1972 | Baustin | 206/534 |
| 3,744,672 | 7/1973 | Dangles et al. | 206/533 |
| 3,926,335 | 12/1975 | Dangles et al. | 206/533 |
| 4,150,766 | 4/1979 | Westendorf et al. | 221/112 |
| 4,288,006 | 9/1981 | Clover, Jr. | 206/534 |
| 4,334,617 | 6/1982 | Rossmo | 206/533 |
| 4,526,293 | 7/1985 | Kramer | 206/540 |

*Primary Examiner*—William Price
*Assistant Examiner*—Brenda J. Ehrhardt
*Attorney, Agent, or Firm*—Joseph H. Roediger

[57] ABSTRACT

A dispenser for tablets from a number of containers each mounted in an inverted position on a rotating support member. Each container is provided with a receiving cap having two angularly disposed passages therein. Each cap is rotatably mounted in a corresponding recess in the support member. The base of the recess is provided with an angularly disposed channel which when aligned with one passage of the receiving means permits a tablet to pass through to the user. The location and angular orientation of passage and channel when in registration results in the dispensing of a single tablet from a container through the support member.

9 Claims, 11 Drawing Figures

APPARATUS FOR THE CONTROLLED DISPENSING OF TABLETS FROM MULTIPLE CONTAINERS

BACKGROUND OF THE INVENTION

This invention relates to apparatus for receiving and supporting a number of tablet containers while permitting the dispensing of tablets from each container to be readily controlled by the user. Thus, the invention provides for the dispensation of single tablets from one or a number of the containers received therein.

At present, the increasing awareness of the general population to the mineral and other nutritional needs of the human body along with the need to periodically replenish the body's reserve of a number of different elements has generated an increasing demand for nutritional supplements. These supplements, normally in tablet form, are frequently necessary for individual health and well-being even though the individual has attempted to maintain the traditional balanced diet.

The analysis of the nutritional needs of an individual is now sufficiently well-developed so as to be capable of being adapted to specific needs. The nutrition industry has responded to this public recognition of specific individual needs by providing a large number of need-specific supplements which are often combined with one or more other supplements according to the requirements of the individual.

All these different specific supplements result in an individual number of containers. Each container is individually opened, a tablet withdrawn, then closed and replaced in a storage area. For the individual needing to combine three, four or five different nutritional supplements on a daily basis, it is a time consuming task. However, there is a recognized tendency on the part of many people to limit their daily activities to what they perceive to be only the necessary functions which provide satisfaction of immediate needs. After the initial enthusiasm of obtaining better nutritional well-being has resulted in improved well-being, the average person begins to view the daily ritual of opening, closing and stowing a number of bottles as a task. At that point, regularity of consuming the needed nutritional supplements is interrupted and an erratic consumption pattern begins to the detriment of the individual.

Accordingly, the present invention is directed to the provision of apparatus for receiving and storing a number of tablet containers in a readily accessible position while providing easy access to the contents. This invention facilitates the dispensing of individual tablets from a plurality of sources. Also, the invention provides user access to individual original tablet containers without requiring removal from the apparatus to effect dispensing of the tablets but each container can be individually replaced without disturbing other containers thereon. Further, tablet dispensing takes place via channels oriented within the apparatus so as to promote the dispensation of single tablets for each single movement of a container.

SUMMARY OF THE INVENTION

The present invention provides access to and controlled dispensing from a number of containers maintained thereon in an inverted position during normal operation.

The apparatus includes a planar support member which is maintained above the basal surface, such as a countertop, by appropriate means for engaging the surface. The support member is preferably rotatably mounted to permit the user to have ready access to all containers. In addition, the upper surface of the support member contains a plurality of recesses therein. A recess is provided for each of the containers to be utilized in a particular embodiment.

A receiving means, dimensioned to removably fit within a recess on the upper surface of the support member, is provided for affixation to a container in place of its conventional cap. Thus, replacement of a container cap with a corresponding receiving means enables the user to place the containers in inverted position on the support member without requiring the manipulation of an open and filled container.

Channel means are formed in the base of each receiving means for providing a passageway from the container through the receiving means. The channel means comprises a plurality of diametrically located passages through the end of each receiving means. Each passage is angularly disposed from the central axis of the receiving means and is provided with an adjacent inclined surface which contacts the edge of a passage. The channel means promotes the siting of a tablet within the passage of the receiving means prior to rotation of the combination of container and receiving means within the support member.

In addition, feed means is located in each of the recesses formed in the top surface of the support member. The feed means communicates between the bottom of the recess and the underside of the support means and is angularly disposed to the plane of the surface of the support means so as to be in substantial alignment with the channel means contained in the receiving means.

As noted, the upper surface of the support means is provided with a plurality of recesses, each of which has a combination of container and receiving means placed therein. The container is inverted with the feed means obtaining a tablet from the supply in the container via a passage in the receiving means. As the container and receiving means are rotated, the tablets become oriented in the channel means for dispensing through the feed means in the support member and appear therebelow The support member is rotatably mounted on the means which maintain it above the basal surface and preferably angularly disposed in relation to the basal surface to both facilitate the movement of tablets within the receiving means and container combination and on through the feed means of the support member and also to aid the user in viewing the containers and grasping same for rotation.

Further features and advantages of the present invention will become more readily apparent from the following description of a preferred embodiment when taken in combination with the accompanying drawings.

DESCRIPTION OF THE PREFERRED EMBODIMENT

Figure 1:
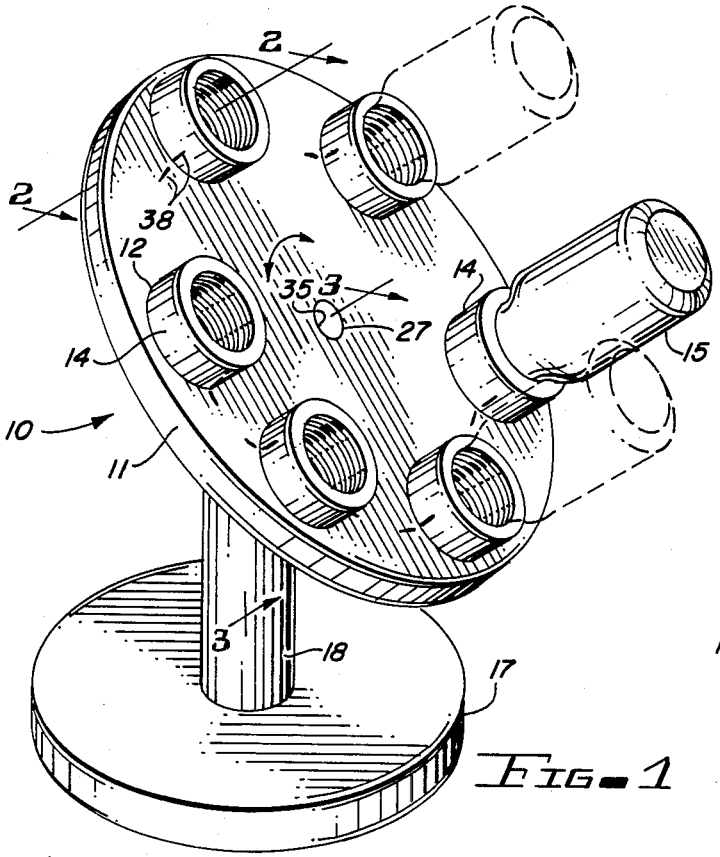
FIG. 1 is a view in perspective of a preferred embodiment of the invention.

Referring to FIG. 1, a preferred embodiment of the invention 10 is shown comprising a circular support member 11 having six recesses formed in the upper surface thereof. The recesses are equally spaced about the peripheral region of the support member and each is shown containing a receiving means 14 dimensioned to fit therein. Each recess 12 is formed a sufficient distance into the surface of the support member so as to provide a firm seat for the receiving means placed therein.

Figure 2:
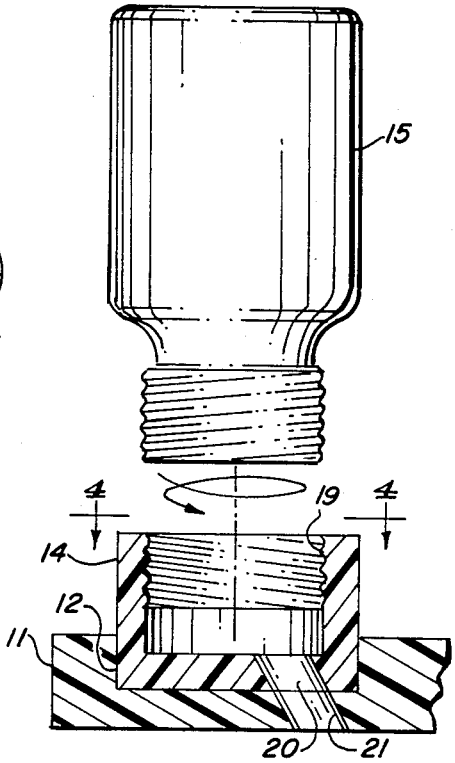
FIG. 2 is a cross-sectional view taken along lines 2—2 of FIG. 1, showing the attachment of the receiving means to a container.

As shown in FIG. 2, the receiving means 14 are provided with internal threads to permit the insertion and securing of a container 15 therein. One such container 15 is shown in its normal operating inverted position in bold outline in FIG. 1, while the two adjacent containers are shown by means of dashed lines. For reasons which will later be more fully explained, each receiving member 14 is removably contained within its corresponding recess. Also, when a container is threaded into the corresponding receiving means, the container rotates along with the corresponding receiving means. Thus, the operator of the tablet dispenser which is the subject of the present invention, need only grasp the end of a container 15 and rotate it to impart relative rotation to the combination of container and receiving means while the support member is stationary.

Figure 3:
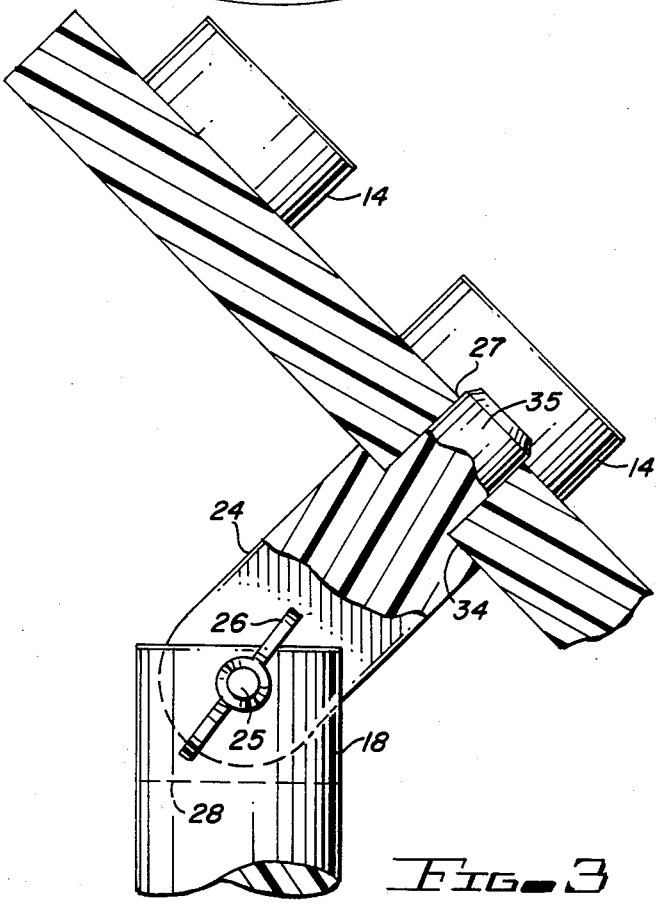
FIG. 3 is a cross-sectional view taken along lines 3—3 of FIG. 1, showing the rotational mounting of the support member.

The planar support member 11 is maintained above a basal surface by stand 17, shown in FIGS. 1 and 3, having a central vertical member 18 extending upwardly therefrom. The upper most portion of member 18 is provided with a transverse slot 28 and a hole perpendicular to the long dimension of the slot which accomodates bolt 25 and and wing nut 26. A narrowed section of adjustable element 24 contains a hole about its lower end through which bolt 25 extends. The adjustment of wing nut 26 permits the angle of element 24 to be varied as desired by the user since the side surfaces of the notched portion of the central vertical member 18 frictionally engage the lower extremity of element 24 when the nut is tightened. This enables the angle between the axis of rotation of support member 11 and the basal surface upon which the embodiment is place to be changed as desired.

The opposing end of element 24 is provided with a central section 35 having a reduced cross-sectional area to thereby form adjacent shoulders 34. The support member having a central opening therein 27 is positioned over the reduced cross-section portion 35 of element 24 so that it is supported and also freely rotated about the axis of the adjustable element. Rotation of the support member is obtained by the user grasping one of the containers 15 and imparting force in either direction to change the position of the support member.

Referring to FIG. 2, the container 15 is shown positioned for insertion into the corresponding receiving means 14. In practice, the recess member is removed from support member 11 and threaded upon the open end of the container when the container is in its upright position. Following assembly, the combination of receiving means and container is inverted and inserted into one of the recesses 12 formed in the upper surface of the support member.

Figure 4:
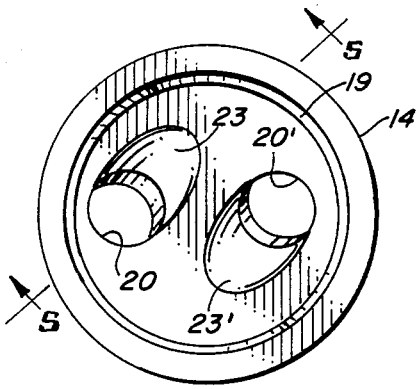
FIG. 4 is a plan view taken along lines 4—4 of FIG. 2, showing the receiving means for the container.

The basal region of a receiving means 14 is shown in FIG. 4 as containing a pair of diametrically spaced passages 20, 20′ therethrough. The thickness of the basal region is substantially equal to the thickness of the tablets to be dispensed. If made greatly in excess of the tablet thickness, multiple tablet dispensing is likely to occur while a relatively thin basal region makes it difficult for tablets to become seated during rotation.

Figure 5:
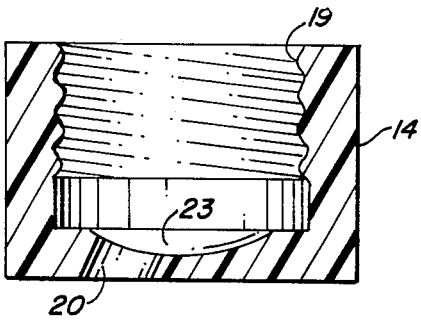
FIG. 5 is a cross-sectional view taken along lines 5—5 of FIG. 4.

Each passage in the receiving means has at least one corresponding inclined surface 23, 23′ adjacent each passageway. It should be noted that each of the passageways 20, 20′ is angled outwardly from the central region of the base. In manufacture, this is obtained by drilling these passageways at an acute angle in relation to the longitudinal axis of the receiving means. The combination of adjacent inclined surface and angularly disposed passageway comprises the channel means which form the path for individual tablets as they are dispensed from the container. The cross-sectional view of FIG. 5 shows more clearly the outward angle of the passageway and its relationship to the adjacent nclined surface. The use of a single inclined surface as shown in FIGS. 4 and 5 limits the direction of rotation of the container and receiving means for effective dispensing. The surfaces 23, 23′ should encounter the tablet to be dispensed prior to its reaching the adjacent passage and as shown in FIGS. 4 and 5 this limits dispensing to clockwise rotation but it is advantageous to utilize two channels per passage so that rotation to effect dispensing can be in either direction.

Figure 6:
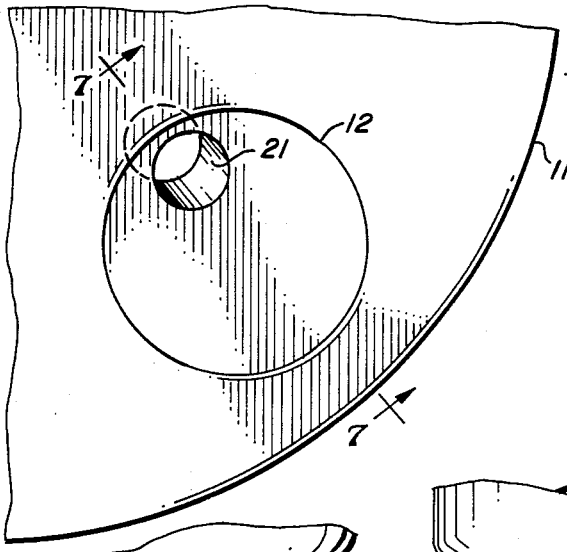
FIG. 6 is a partial plan view of a channel means and recess formed in the support member.
Figure 7:
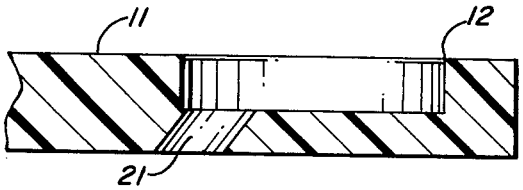
FIG. 7 is a cross-sectional view taken along lines 7—7 of FIG. 6.

In FIG. 6, a recess 12 formed in the planar support member 11 is shown containing the feed means 21 which communicates between the passageway in the receiving means 14 and the underside of the support member 11. When these elements are in alignment due to rotation of the receiving means within its recess in the support member, a tablet contained therein will drop through the support member and be available to the consumer. Referring to the cross-sectional view of FIG. 7, the feed means 21 is shown angularly disposed in an outward direction from the recess. This angle is substantially equal to the angle of the channel means opening formed in the receiving means. It should be noted that the angle is directed toward the central region of the support member.

Figure 8A:
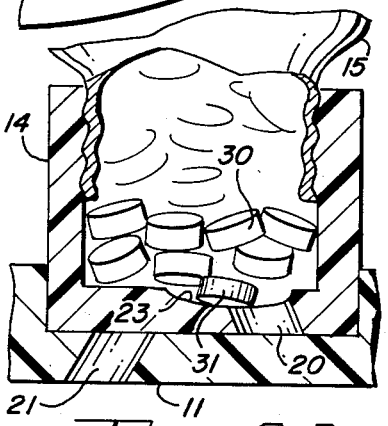
FIGS. 8A, 8B and 8C show a sequence of steps in the dispensing operation of the embodiment of FIG. 1.
Figure 8B:
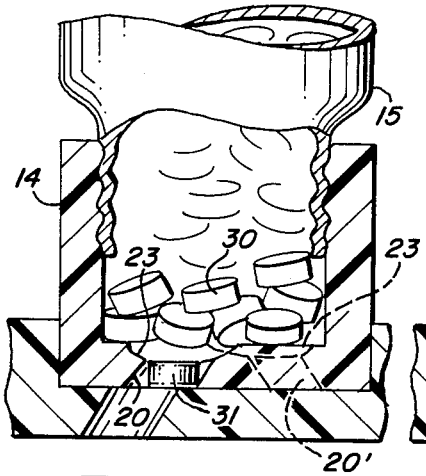
Figure 8C:
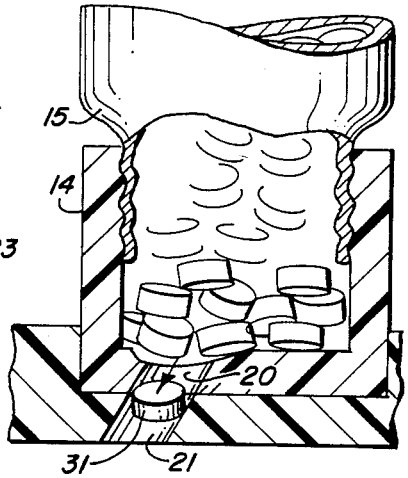

FIGS. 8A, 8B and 8C show the steps in the dispensing of an individual tablet from a container 15 threadedly engaged within the receiving means 14. FIG. 8A shows a tablet 31 residing within the region of the inclined surface and resting thereagainst prior to entering into the channel opening 20. A multiplicity of tablets 30 overly this individual tablet 31 and tend to urge it to the lowest position in the container. At this point in time, the channel opening is spaced from the feed means opening and the tablet cannot be discharged.

The rotation of the combination of receiving means 14 and container 15 result in movement of the tablets within the combination and, in particular, the movement of tablet 31 down the inclined surface and into channel opening 20. The opposing channel opening 20' is shown having a tablet moving along its inclined surface 23' in preparation for the dispensing of a subsequent tablet. Further rotation of the combination of receiving means and container results in the movement of tablet 31 from the channel opening 20 into the feed means 21 whereupon it is discharged into the hand of the user below the support member The support member and receiving means are each provided with indicia 38 shown in FIG. 1 which when aligned indicate to the user that the channel and feed means are not aligned thereby preventing uncontrolled dispensing of tablets.

The ability to change the angle of the support member 11 by use of the threaded fastener 25 and wing nut 26 permitting movement of element 24 in the vertical member 18 has been found to substantially reduce the tendency of multiple tablets to be discharged by a single rotation of the combination of container and receiving means. In addition, the tilting of the support member facilitates the user keeping his hand in one location while he rotates the containers and support means to receive a series of tablets from different containers. By tilting the support member so that the tablet containers 15 are not vertical, the major force exerted by tablets above the individual tablet to be dispensed is directed at the lowermost portion of the receiving means. The combination of channel means and feed means is intentionally located above the lower edge of the container and angularly disposed so that the force of the overlying tablets is not directed to urging multiple discharge of tablets through the combined aligned passageways.

The rotation of the combination of container and its receiving means results in a movement of the tablets within the container and the enhanced opportunity for each tablet to become substantially parallel to the inclined surface adjacent each channel opening. This feature also aids in the orientation of the tablet for discharge and reduces the possibility of multiple tablets being discharged when the passageways are in alignment as shown in FIG. 8C.

Figure 9:
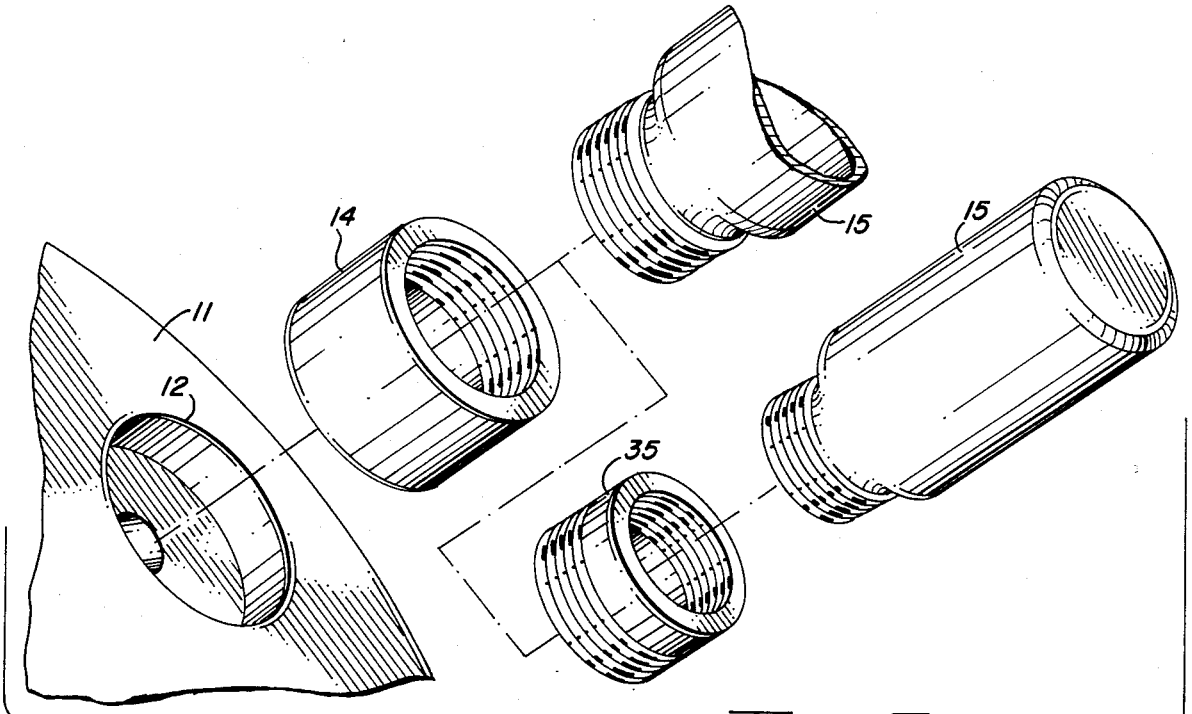
FIG. 9 is an exploded view of the receiving means for different size containers.

In order to accomodate containers of different capsize, the double threaded reducing members 35 are provided. For example, the container 15 and receiving member 14 shown in FIG. 9 are in alignment for placement within the recess 12 of the support member. As shown, the container 15' having a different diameter cap-size is provided with a reducing section 35 to be threaded on the container 15' and within the receiving means 14. Once threaded in place upon the container 15', a receiving means 14 is threaded thereover prior to placing the combination within the appropriate recess in the support member 11. While the above description has referred to a specific embodiment of the invention it will be recognized that many modifications and variations may be made therein without departing from the scope of the invention as claimed.

What is claimed is:

1. Apparatus for controlling the dispensing of articles from a plurality of individual containers which comprises:

(a) a support member having first and second opposing surfaces, said first surface including a plurality of recesses therein;

(b) feed means located in each of said plurality of recesses for communicating between the corresponding recess and the second surface of the support member;

(c) removable receiving means dimensioned to fit within one of said plurality of recesses for receiving an open end of one of said containers and supporting same in an inverted position on the support member, said receiving means being movably fitted within said recess;

(d) channel means formed in each of said receiving means for providing passageways therethrough for articles within said container; and (e) means for engaging a basal surface and maintaining said support member in a spaced overlying position, the rotation of a receiving means into alignment with a channel means resulting in the dispensing of an article from the container received therein.

2. Apparatus in accordance with claim 1, wherein each of said removable receiving means comprises a cylindrical member having inner and outer peripheral surfaces and an inner end, said inner peripheral surface including means for engaging an individual container.

3. Apparatus in accordance with claim 2, wherein said outer peripheral surface of each receiving means is dimensioned to fit within a corresponding recess and permit withdrawal therefrom.

4. Apparatus in accordance with claim 3 further comprising means for adjusting the angle of the support member in relation to the basal surface.

5. Apparatus in accordance with claim 3, wherein said inner end of each of said cylindrical members is provided with channel means for providing at least one passageway through said inner end, said channel means being angularly disposed with respect to the longitudinal axis of the cylindrical member.

6. Apparatus in accordance with claim 5, wherein the passageway of said channel means is angularly disposed toward the outer peripheral portion of the cylindrical member.

7. Apparatus in accordance with claim 6, wherein each of said channel means comprises first and second passageways located in the end of the cylindrical member and each extending outwardly toward the outer peripheral portion thereof.

8. Apparatus in accordance with claim 6, wherein said channel means further comprises at least one inclined surface located on the inner end of the cylindrical member and extending downwardly to said passageway.

9. Apparatus in accordance with claim 7, wherein said channel means further comprises first and second inclined surfaces located in the inner end of the cylindrical member adjacent said first and second passageways respectively and cxtending downwardly thereto.

* * * * *